US006854407B2

(12) United States Patent
McCollum et al.

(10) Patent No.: US 6,854,407 B2
(45) Date of Patent: Feb. 15, 2005

(54) METHOD FOR CONSTRUCTING A VERY LARGE TURRET MOORING ARRANGEMENT

(75) Inventors: Jerry L. McCollum, Hempstead, TX (US); L. Terry Boatman, Houston, TX (US); Richard M. Corder, Sealy, TX (US); Charles L. Garnero, Cypress, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/460,083

(22) Filed: Jun. 11, 2003

(65) Prior Publication Data

US 2003/0205188 A1 Nov. 6, 2003

Related U.S. Application Data

(63) Continuation-in-part of application No. 10/350,729, filed on Jan. 24, 2003, now abandoned.
(60) Provisional application No. 60/351,786, filed on Jan. 25, 2002.

(51) Int. Cl.[7] ..... B63B 21/00
(52) U.S. Cl. ..... 114/230.12; 114/65 R
(58) Field of Search ..... 114/230.1, 230.12, 114/65 R

(56) References Cited

U.S. PATENT DOCUMENTS 4,698,038 A * 10/1987 Key et al. ..... 441/5
5,860,382 A * 1/1999 Hobdy ..... 114/230.15

FOREIGN PATENT DOCUMENTS

JP 361150886 A * 7/1986

OTHER PUBLICATIONS

"Machining of bearing surface", FMC Energy Systems.*
"Machinging of bearing surfaces for Barracuda P34", FMC Energy Systems.*

* cited by examiner

*Primary Examiner*—Sherman Basinger
(74) *Attorney, Agent, or Firm*—Gary L. Bush; Andrews Kurth LLP

(57) ABSTRACT

A method for constructing and installing a very large turret in a vessel without lifting the entire turret from a fabrication yard into the moonpool. According to a first alternative method, both the lower part and the upper part of the turret are constructed inside the moonpool while the vessel is in drydock. Such method obviates providing very large lifting cranes capable of lifting the entire turret including the upper part of the turret and the lower part into the moonpool. According to a second alternative embodiment, the turret has an upper part and a lower part and the lower part is constructed in the moonpool while the vessel is in drydock, like in the first alternative method. In the second embodiment, the lower part is supported by rods and jacks from the moonpool, and the vessel is floated out of drydock into the water and parked at dockside. The upper part of the turret is then lifted in place with a crane of moderate size and connected to the lower turret part with bearings installed between the upper part and the moonpool.

9 Claims, 17 Drawing Sheets

26U
100
26R
1
26B'
200
26B
78
78
2
2
5
3
120
110
105
110

13
12
24
16
16
5
110
105
4
13
6
16
3

11A
11B
24
2A
100
30
5
3
2
6
2
1
24
8
500

METHOD FOR CONSTRUCTING A VERY LARGE TURRET MOORING ARRANGEMENT

CROSS REFERENCE TO RELATED APPLICATION

This application concerns a method of construction related to the invention disclosed in co-pending U.S. non-provisional application 10/325,122 filed on Dec. 19, 2002 and hereby incorporates by reference the disclosure of that prior application. This application is a Continuation-In-Part application of U.S. non-provisional application 10/350,729 filed on Jan. 24, 2003 (now abandoned), which was based upon prior-filed provisional application 60/351,786 filed on Jan. 25, 2002 the priority of which is claimed.

BACKGROUND OF THE INVENTION

1. Field of the Invention

This invention relates to turret mooring systems in general and in particular to a method for constructing a very large turret in a moonpool of a vessel while at drydock.

2. Description of the Prior Art

Prior turrets for turret mooring systems have been built as an integral unit and installed with cranes into a moonpool of a vessel while the vessel is in drydock. With an extremely large turret, the turret is too large for most shipyards, because they do not have lifting cranes large enough so that the turret can be constructed externally of the vessel and then lifted into the moonpool for installation. An extremely large turret is one which is capable of supporting up to sixty risers or more.

3. Identification of Objects of the Invention

A primary object of this invention is to provide a method for installing a Very Large Turret in a vessel for a turret mooring system.

Another object of the invention is to provide a method of installing a Very Large Turret in a moonpool of a vessel while the vessel is in drydock.

Another object of the invention is to provide a method of installing a lower portion of a Very Large Turret in a moonpool of a vessel while the vessel is in drydock and after the vessel has been moved to the water and at dockside, lifting a top deck onto the lower portion of the turret followed by final construction steps.

SUMMARY OF THE INVENTION

The objects identified above and other features and advantages are incorporated in a method by which a Very Large Turret (one that can support from 60 to 120 risers from sea bed wells) is constructed at least in part or entirely in the moonpool of a vessel while the vessel is in drydock. According to one embodiment of the invention, substantially the entire turret including the chain table, column and main deck is constructed while the vessel is in dry dock. A large surface machining tool is employed to machine upper rail surfaces on the moonpool and upper and lower and radial surfaces of the main deck while it is being assembled in place in the moonpool. The vessel is not floated out of drydock into the water from drydock until the turret construction is substantially complete in order to avoid using massive lifting cranes during construction of such a large turret.

According to an alternative embodiment, the chain table and columns and an intermediate deck are constructed in the vessel's moonpool while the vessel is in drydock, but the main deck is fabricated at a fabrication yard and lifted onto the column or columns of the partially completed turret after the vessel has been floated out of drydock into the water and is dockside. A large lifting crane is used to lift the main deck in place.

DESCRIPTION OF PREFERRED EMBODIMENTS

Embodiment with Main Deck of Turret Constructed while the Vessel is in Drydock

Figure 1:
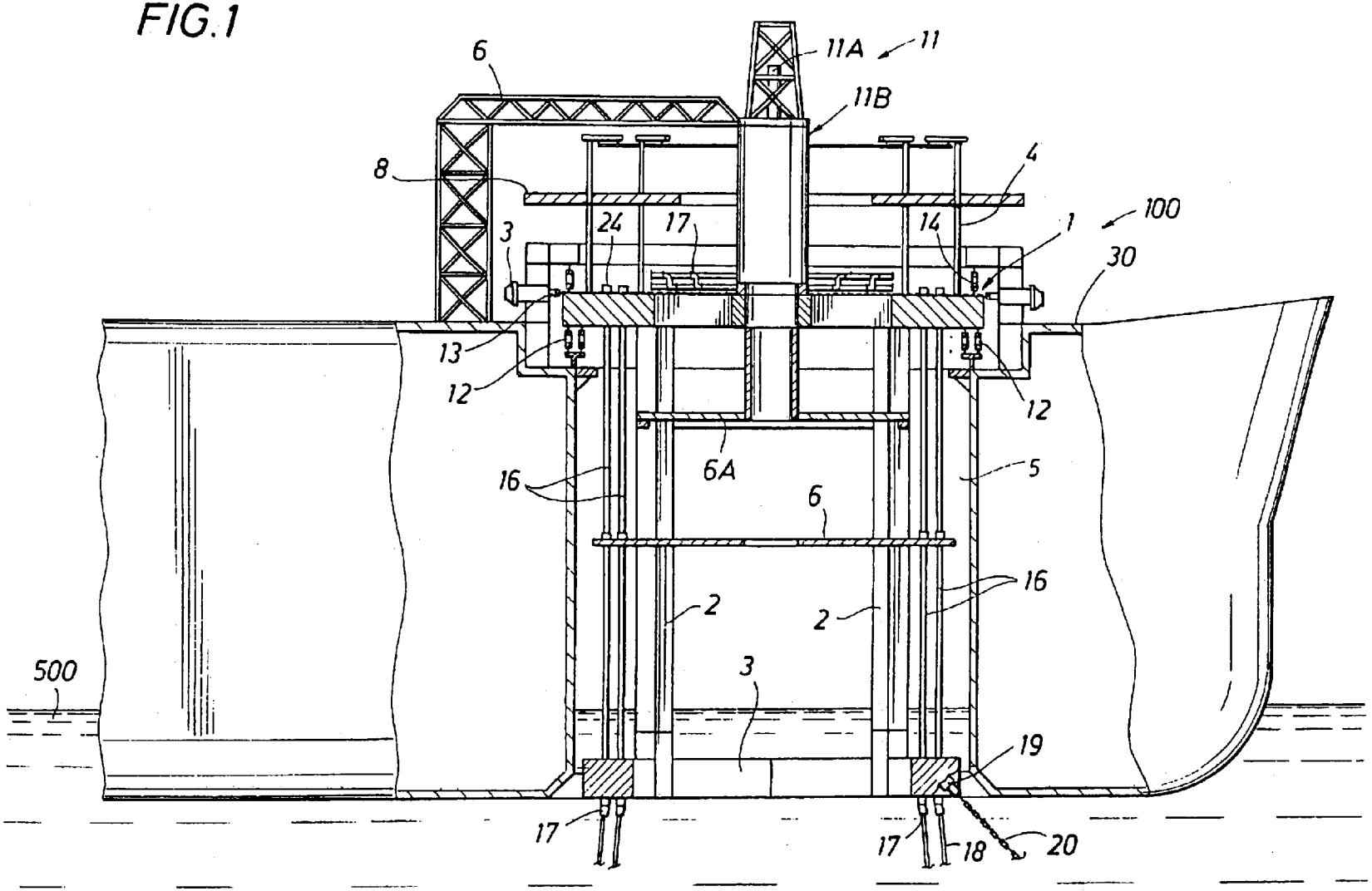
FIG. 1 illustrates in a cut-away view (partially in cross-section) a preferred Very Large Turret installed in a moonpool of a vessel according to the method of the invention. The phrase, Very Large Turret, as applied to the turret of FIG. 1 implies a structural frame weight of, for example, 2,300 metric tons comprising a main deck (1,100 tons), six columns (660 tons @ 110 tons/column), and a chain table of 440 tons. The welding operations of the method include distortion control and thermal stress relief. Machining is performed with portable machining equipment to obtain large diameter machining accuracy. The turret is massive by conventional standards, capable of supporting from 60 to 120 risers.

The preferred arrangement of the very large turret 100, to be constructed according to the methods described herein, is described in detail in the above-mentioned U.S. application Ser. No. 10/325,122 and incorporated by reference herein. FIG. 1 shows a side view of one representative embodiment with a cut-away cross-section of a vessel 30 in which the turret 100 is rotatably supported on bearing surfaces within a moon pool 5 of the vessel 30 by a vertical bearing arrangement 12 and a radial bearing arrangement 13 comprising rail-roller arrangements. The vertical bearing rollers 12 and radial bearing rollers 13 are seen more clearly in FIG. 4A.

The main deck 1, to which the vertical roller bearings 12 and radial roller bearings 13 provide rotatable support with respect to the vessel 30, is designed to have a predetermined flexibility as described in the above-mentioned U.S. application Ser. No. 10/325,122 so as to accommodate vessel sagging and hogging caused by rough seas. The main deck 1 carries chain table 3 by means of support columns 2. As explained in the above-mentioned patent application, a single column could be substituted for the six support columns as illustrated herein. Chain table 3 supports three sets of anchor legs 20 via three sets of chain supports 19. Risers 18 run from sea bed locations (e.g. subsea wells) through bend stiffeners 17 and through riser or "I" tubes 16 which extend through chain table 3 and access platform 6 to the main deck 1. Riser hang-off devices 24 are carried by main deck 1. Piping (not shown) from risers 18 extends via stations 17 for manifolding and pig launching/receiving and ultimately to a swivel stack and torque tube 11. A pull-in deck 8 is supported by columns 4 from main deck 1. A winch and sheave arrangement (not shown) is mounted on deck 8 for pulling in anchor legs 20 and risers 18. A torque arm 6 is provided between the vessel 30 and torque tube 11.

The turret 1 of FIG. 1 is very large. For example; its structural frame weight for one design is 2,300 metric tons comprising a main deck 1 of 1,100 tons, six columns 2 each weighing 110 tons each for a total of 660 tons and a chain table 3 of 440 tons. Such size makes it practically and commercially impossible to build the entire turret at a shipyard and later lift it onto a floating vessel. The difficulty faced is that most shipwards of the world do not have lifting cranes with the capacity to lift an assembly of such massive weight. The first method described here provides steps for constructing the turret in the moonpool of the vessel while at drydock in a shipyard.

Figure 2:
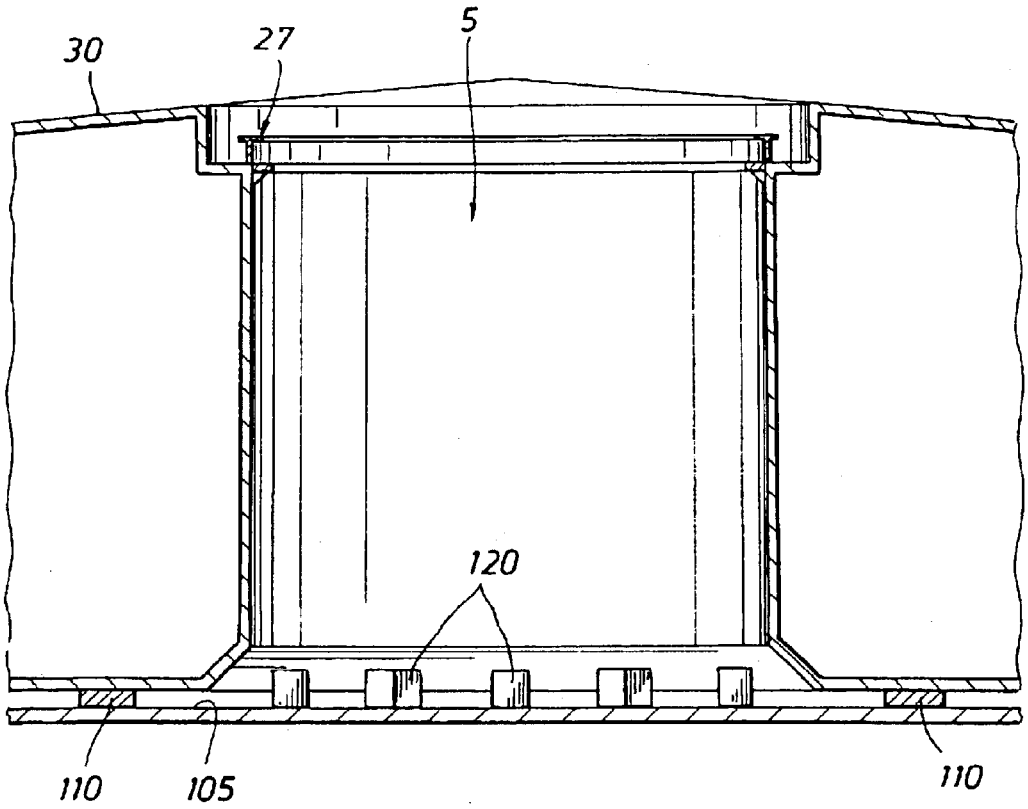
FIG. 2 shows a vessel in drydock with a moonpool installed and blocks on the drydock floor set and leveled. Vessel blocks are shorter than turret support blocks. A T-flange is installed at the top of the moonpool for mounting of rails for an axial bearing comprising a roller/rail arrangement.

FIG. 2 shows the vessel 30 in drydock supported on the drydock floor 105 by blocks 110. A moonpool 5 is constructed in the vessel 30, and a T-flange 27 is installed on an upper peripheral surface of a cylindrical extension of the moonpool 5. Refer to FIG. 4A for a larger view of rail 27 and its structural relationship to moonpool 5. Blocks 120 are set and leveled on the floor 105 of the drydock. Blocks 120 are higher than are blocks 110 so that when the turret 100 is completed, sufficient space exists above T-flange 27 to machine surfaces on the main deck 1, as will be explained in more detail below.

Figure 3:
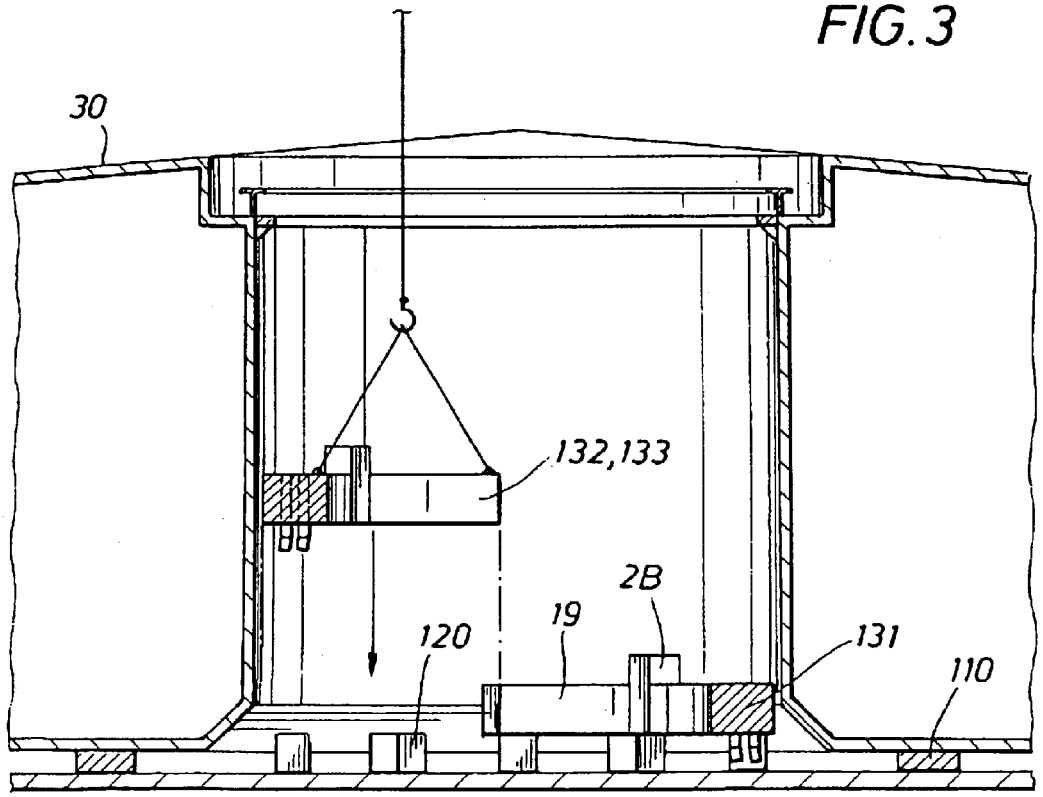
FIG. 3 shows the chain table being constructed in three 120° segments on the turret support blocks.

FIG. 3 shows the first, second and third sections 131, 132, 133 of the chain table 3 lowered onto blocks 120 by a hook by means of a crane (not shown). The chain support blocks 19 are provided for each section. The bases 2B for columns 2 are mounted on each chaintable section. Bell mouths and bend stiffeners for passage of risers are provided for each chain table sector.

Figure 4:
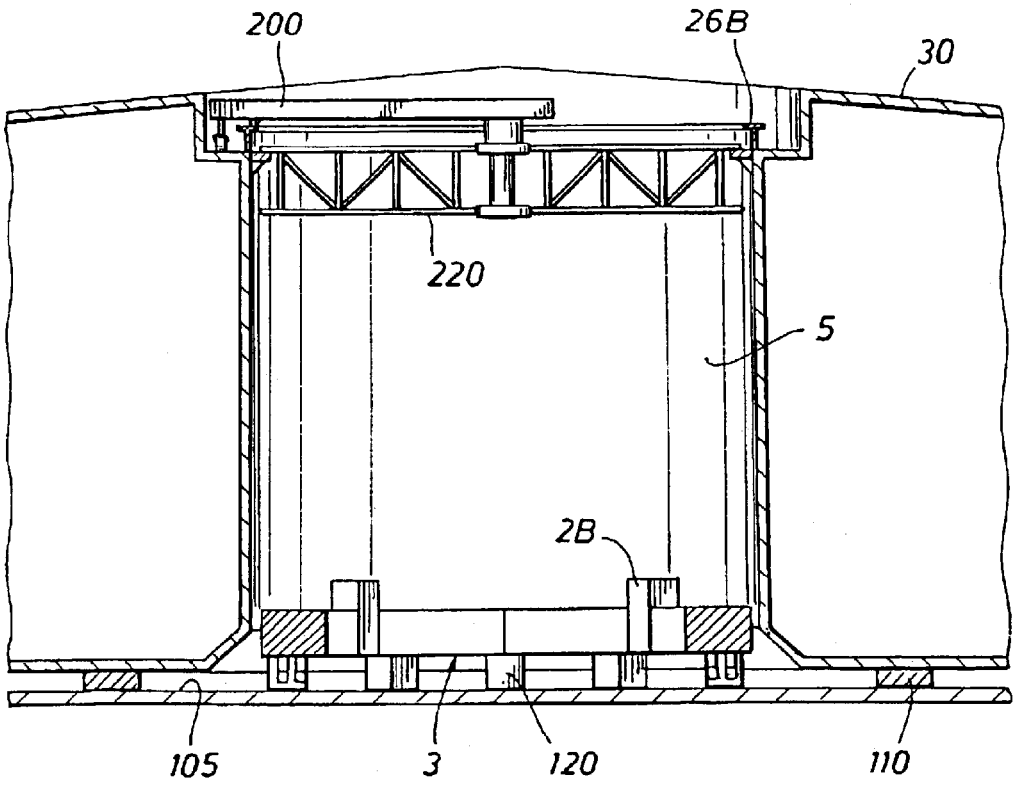
FIG. 4 shows a surface machining tool placed on a frame support for machining rail surfaces on a T-flange of the moonpool.
Figure 4A:
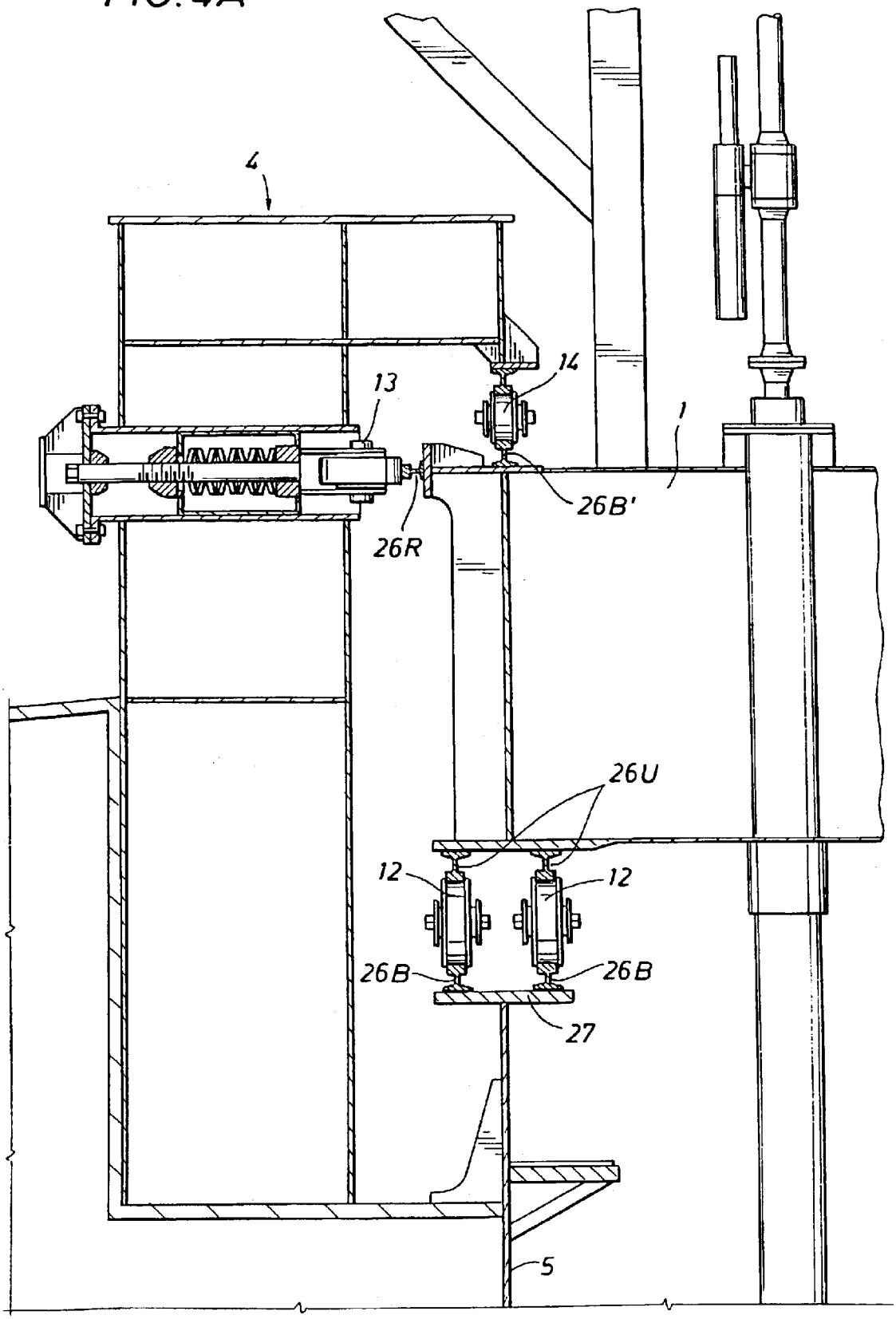
FIG. 4A illustrates the T-flange and roller rail surfaces for axial and radial bearing arrangements for the main deck.

Next, as illustrated in FIGS. 4 and 4A, the rails 26B of flange 27 of the moonpool 5 are machined with a surface machining tool 200 which is supported on a truss frame support 220 secured to a shelf of moonpool 5. The surface machining tool 200 is an extra large circular self-leveling mill such as manufactured and operated by Self Leveling Machines, Inc. FIG. 4A illustrates more clearly the rails 26B which are machined by machine tool 220. (Alternatively, the T-rail flange can be machined prior to installation of rails 26B).

Figure 5:
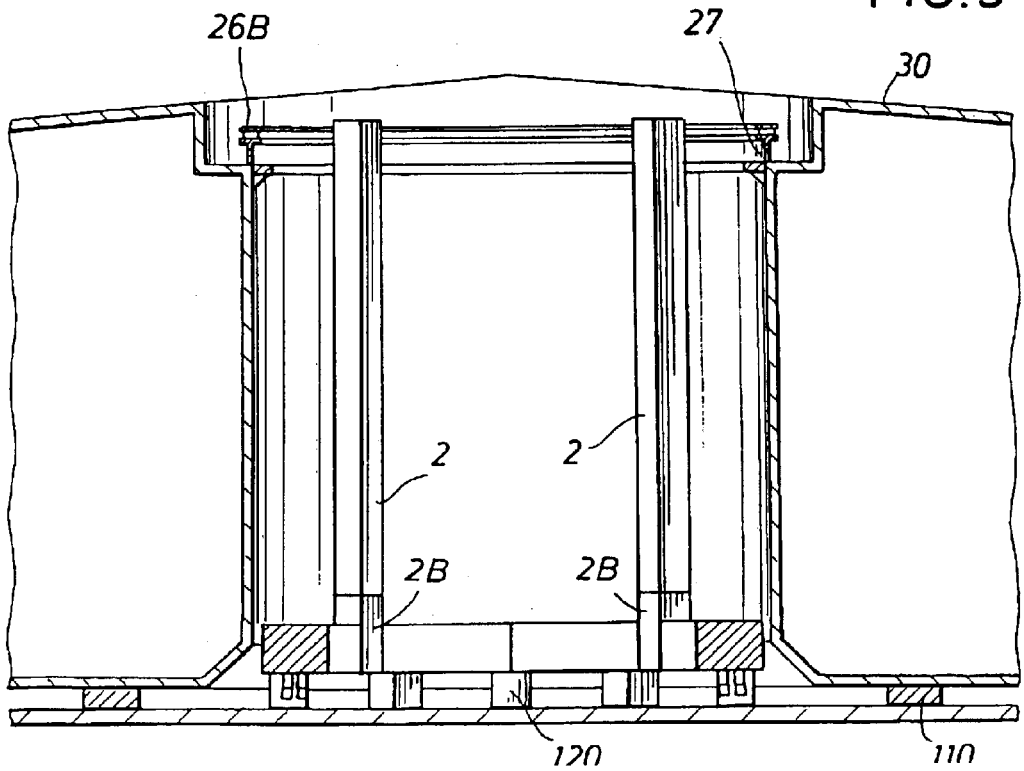
FIG. 5 shows columns extending upwardly from the chain table and shows the machined rails installed on the T-flange of the moonpool.

In FIG. 5, the machined rails 26B are shown on the T-flange 27, and columns 2 are erected from the bases 2B as illustrated in FIGS. 3 and 4.

Figure 6:
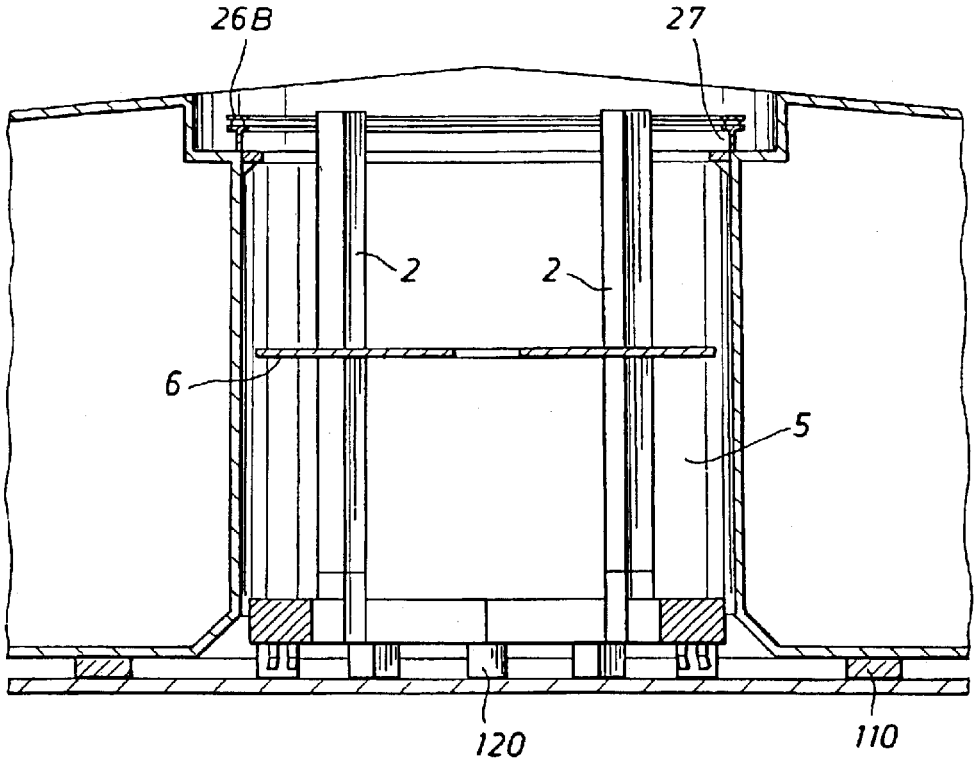
FIG. 6 illustrates a first access platform installed at mid-height of the columns.
Figure 7:
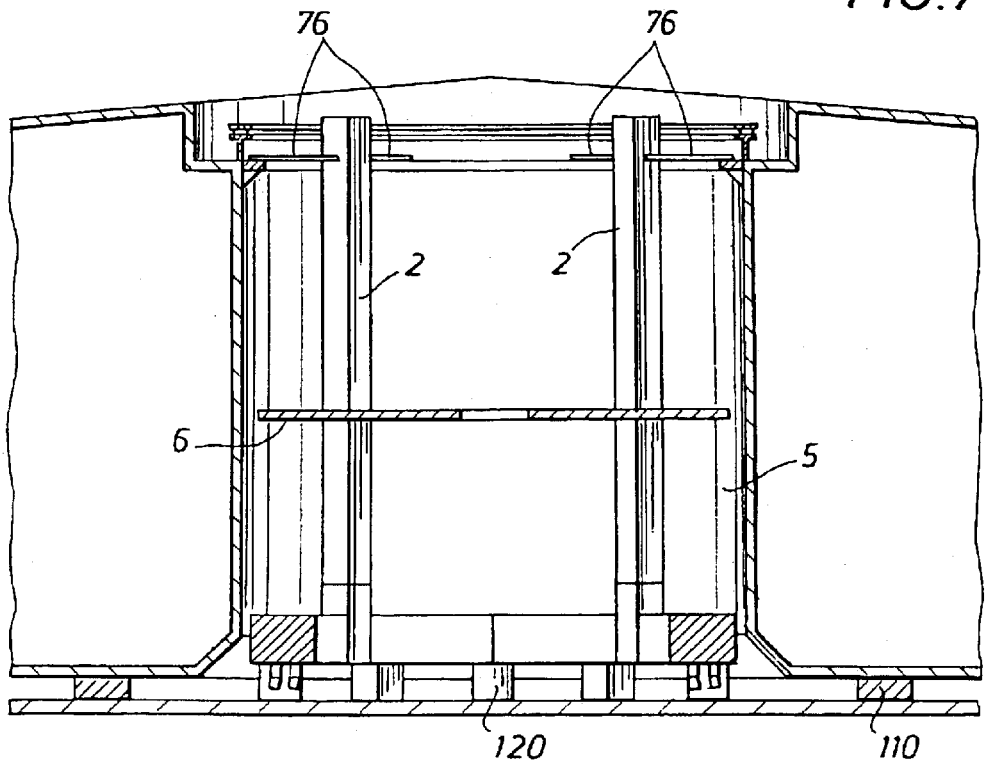
FIG. 7 illustrates bracing members installed between the columns and the moonpool for aligning and bracing the columns.
Figure 8:
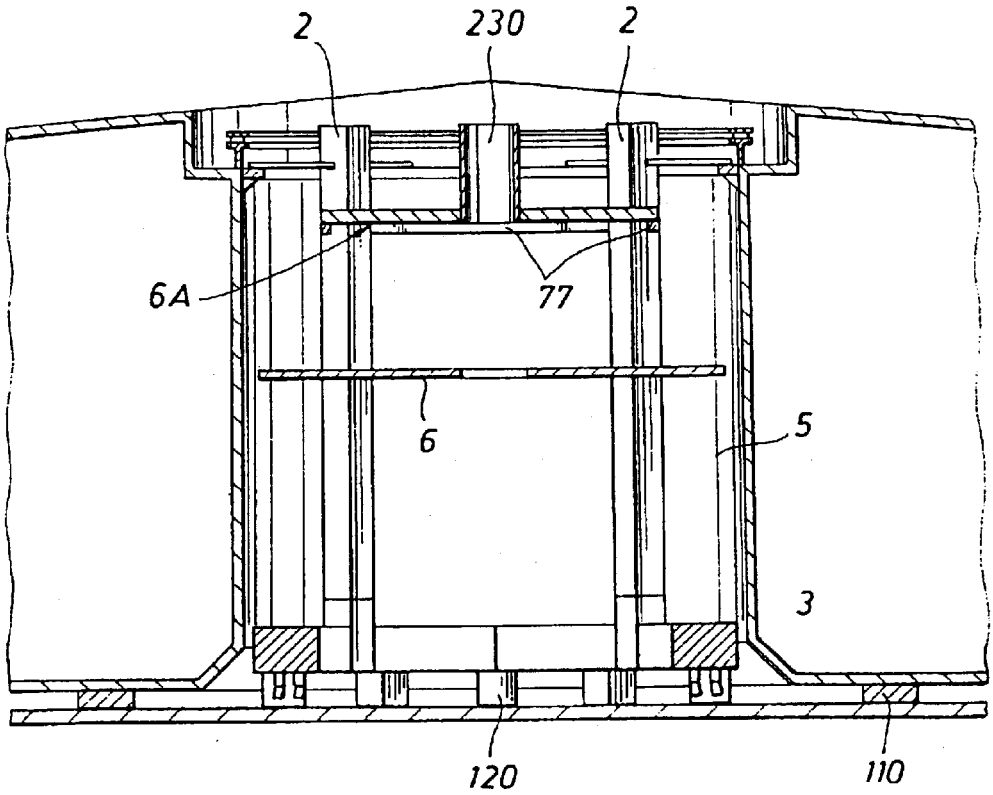
FIG. 8 illustrates installing a second access platform with bracing on the columns.

As illustrated in FIG. 6, an access platform 6 is installed on columns 2, and as shown in FIG. 7, bracing members 76 are provided between the column 2 and the moonpool 5 to provide construction stability. Such bracing members 76 are removed after the main deck is later constructed and supported with respect to the moonpool by the bearing arrangement. FIG. 8 shows an upper access platform 6A being installed with column to column bracing 77 providing alignment. A support member 230 is installed which will become part of the hub of the main deck. The support member 230 is installed on deck 6A prior to its installation onto the turret.

Figure 9:
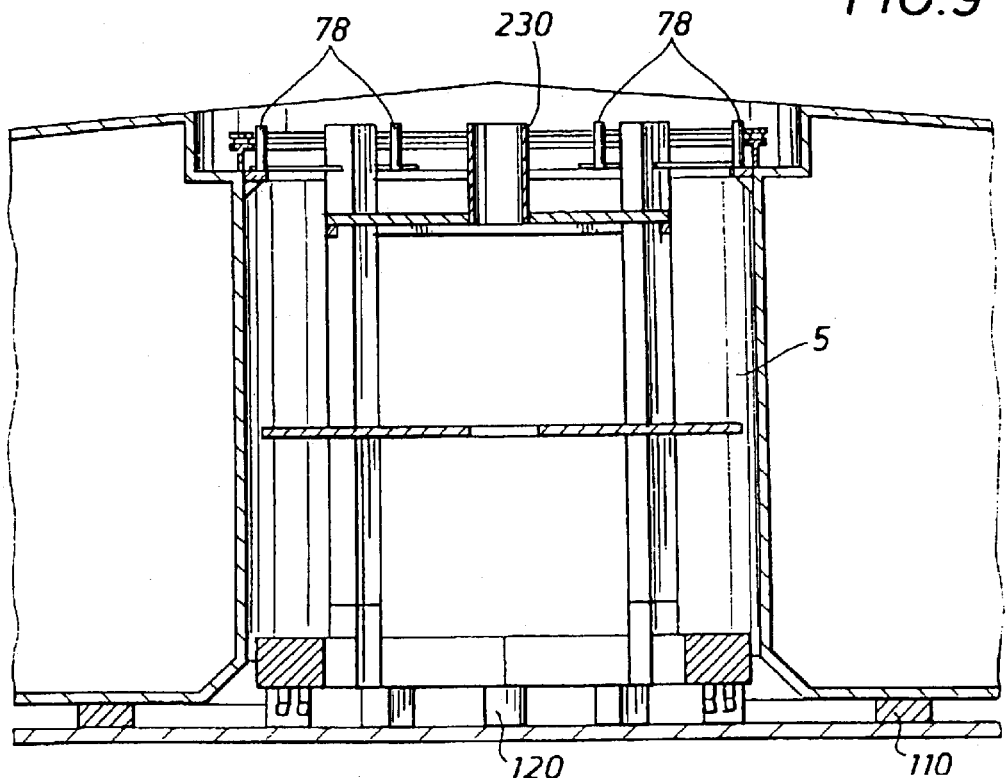
FIG. 9 illustrates installation of alignment jacks on a shelf of the moonpool.
Figure 10:
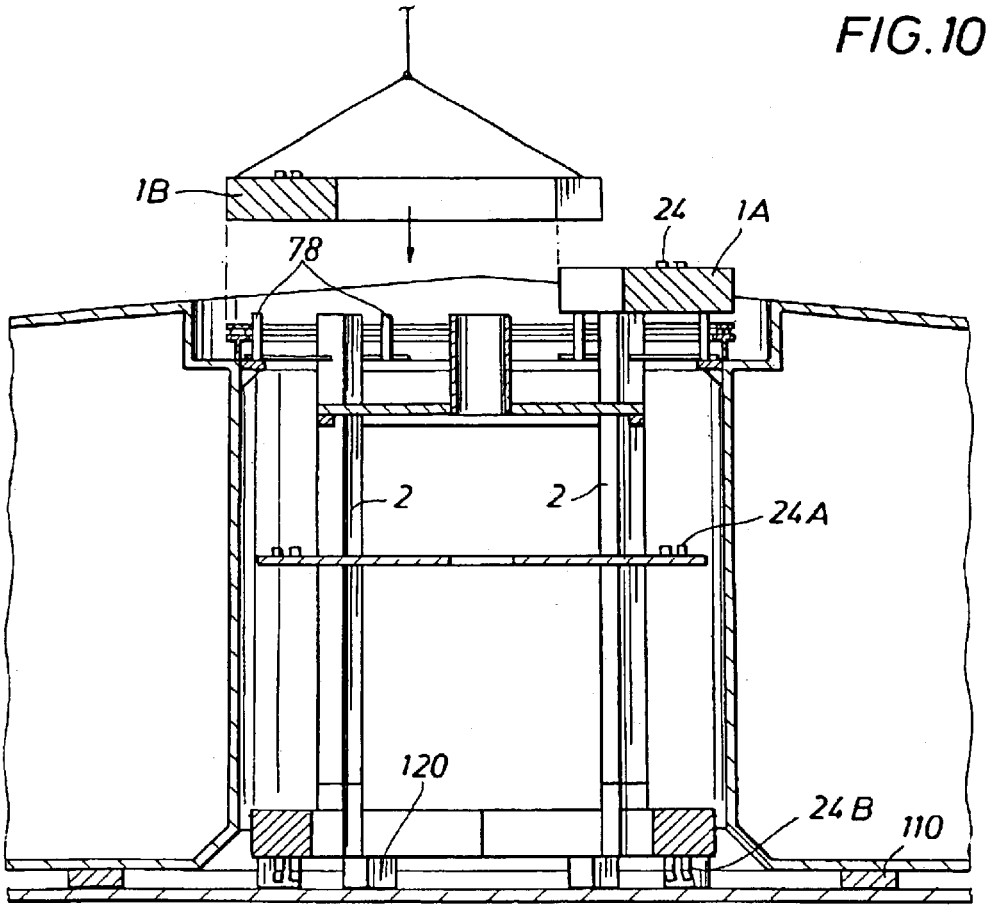
FIGS. 10–13 illustrate assembly of the main deck which includes a hub with six spokes (see especially FIG. 13) and mounting of the main deck to the support columns.
Figure 11:
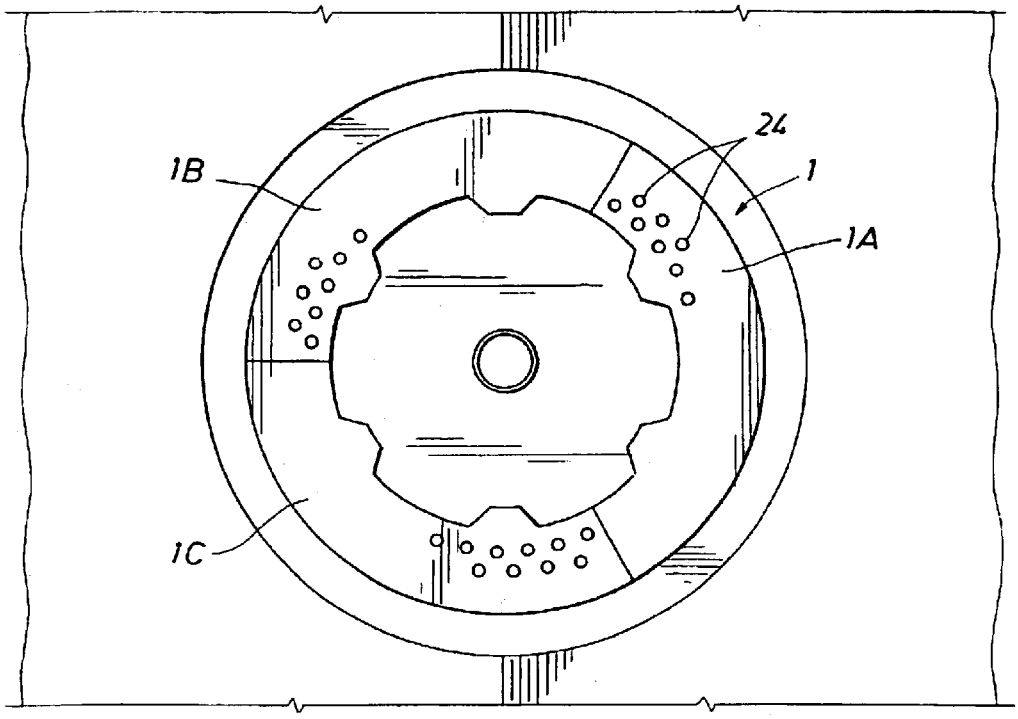
Figure 12:
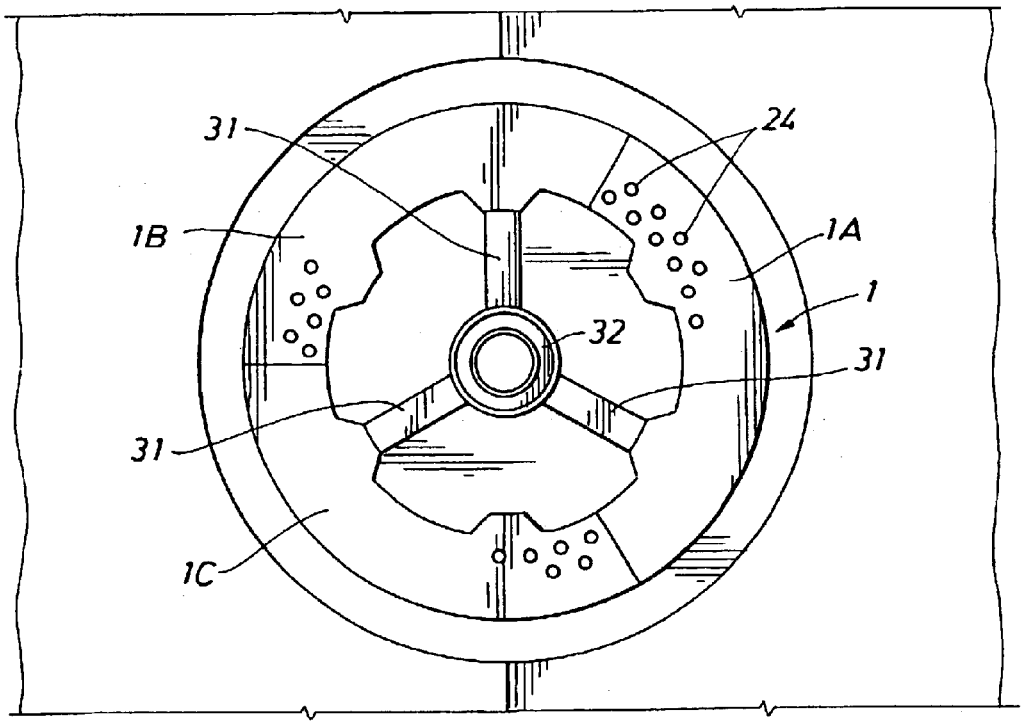
Figure 13:
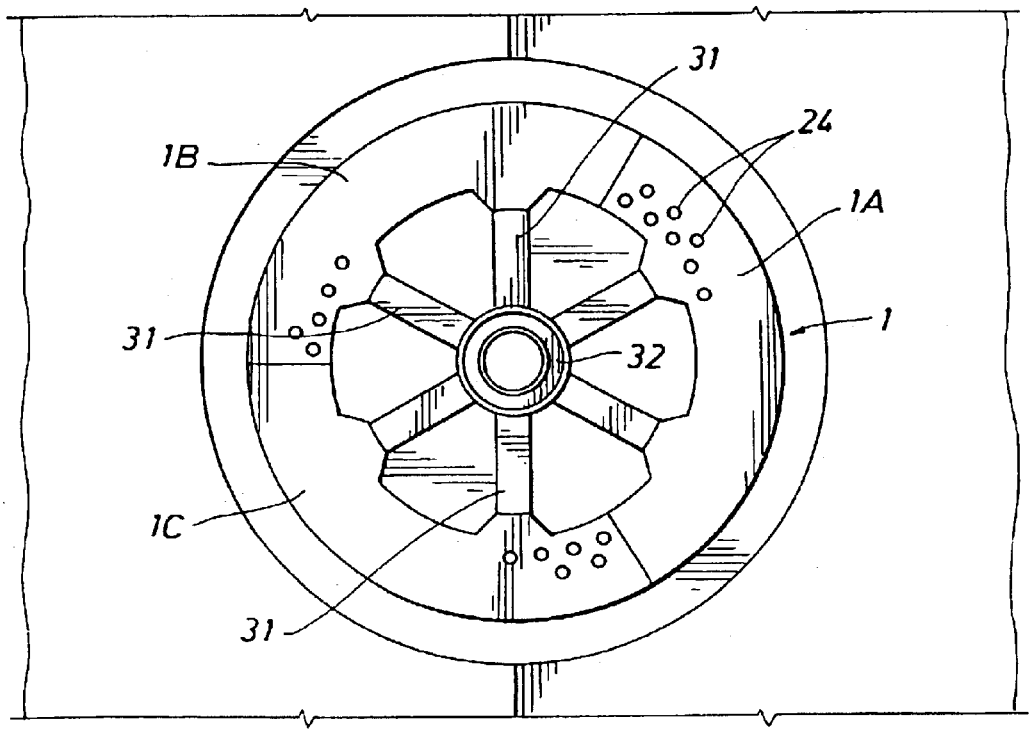

FIG. 9 shows alignment jacks 78 installed about an upper shelf of moonpool 5. FIG. 10 shows sections of main deck 1 being lowered for welding on top of columns 2. Jacks 78 assist in the leveling of main deck section 1A, 1B and 1C on columns 2. The main deck 1 is being constructed in sections atop the vessel while the vessel remains in drydock in order to obviate the need for massive lifting cranes. FIG. 11 is a top view of main deck 1 with sections 1A, 1B and 1C in place on top of column 2. FIG. 12 shows a hub 32 and spokes 31 installed, and FIG. 13 shows three more spokes installed to complete the construction of main deck 1. Riser hangoffs 24 are installed in the outer ring of main deck 1. Such hangoffs 24 are aligned with corresponding openings 24A, 24B in deck 6 and chain table 3. During installation, the sections 1A, 1B, 1C are leveled, welded together, and machined before being lowered onto the columns 2 and welded thereto.

Figure 14:
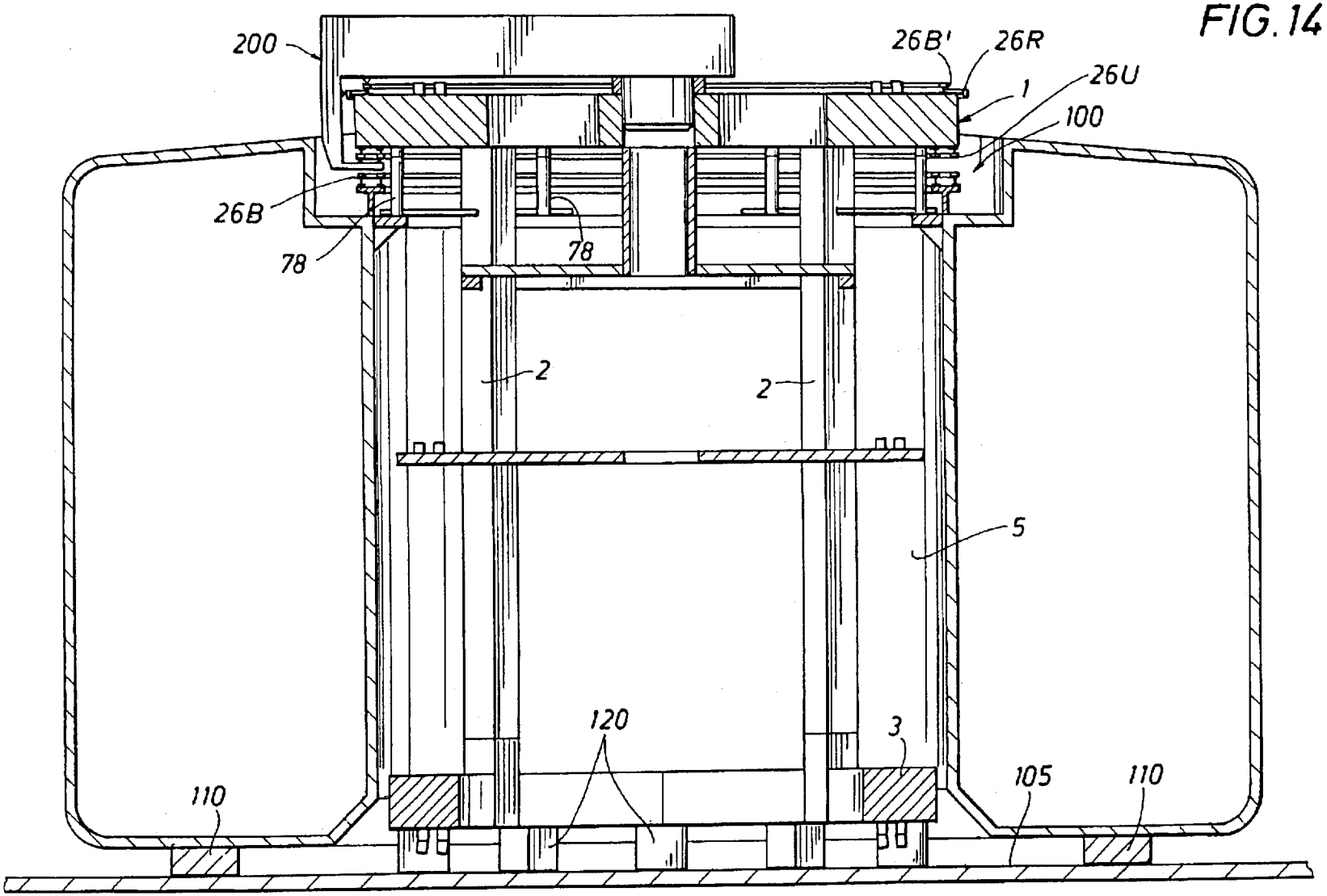
FIG. 14 illustrates machining of three main deck bearing surfaces with fine alignment with jacks between the main deck and moonpool shelf after initial bracing has been removed and with vertical machining space provided by turret support blocks being higher than vessel support docks.

FIG. 14 illustrates that the surface machining tool 200 is used again, this time to machine an outer rail 26R of main deck 1 and vertical bearing rail surfaces 26U and 26B' (See FIG. 4A) with vertical clearance of main deck 1 achieved, because turret support blocks 120 are vertically taller than are vessel support blocks 105. (Alternatively, the support surfaces for the rails 26U, 26B and 26R may be machined prior to installation of such rails on the support surfaces). In other words, the support blocks 120 provide sufficient vertical clearance beneath main deck 1 to allow tool 200 to reach below deck 1 and above rails 26B for milling operations. The entire turret 100 weight continues to rest on blocks 120 on drydock floor 105.

Figure 15:
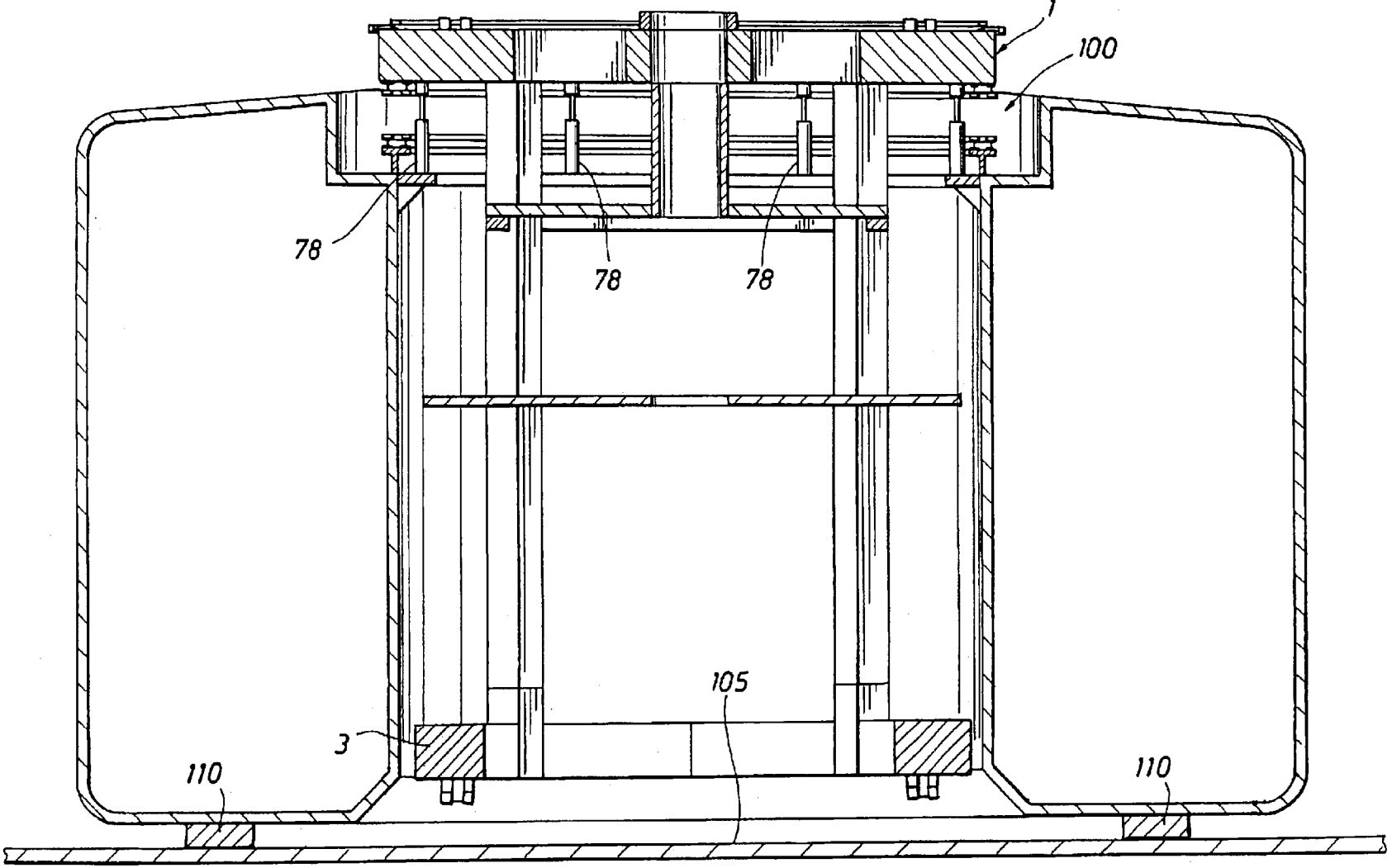
FIG. 15 illustrates using jacks to raise the entire turret from the drydock floor.

Next, as shown in FIG. 15, alignment jacks 78 raise the entire turret 100 (maindeck 1, column 2, and chain table 3) enough to provide vertical clearance below chain table 3 to remove blocks 120.

Figure 16:
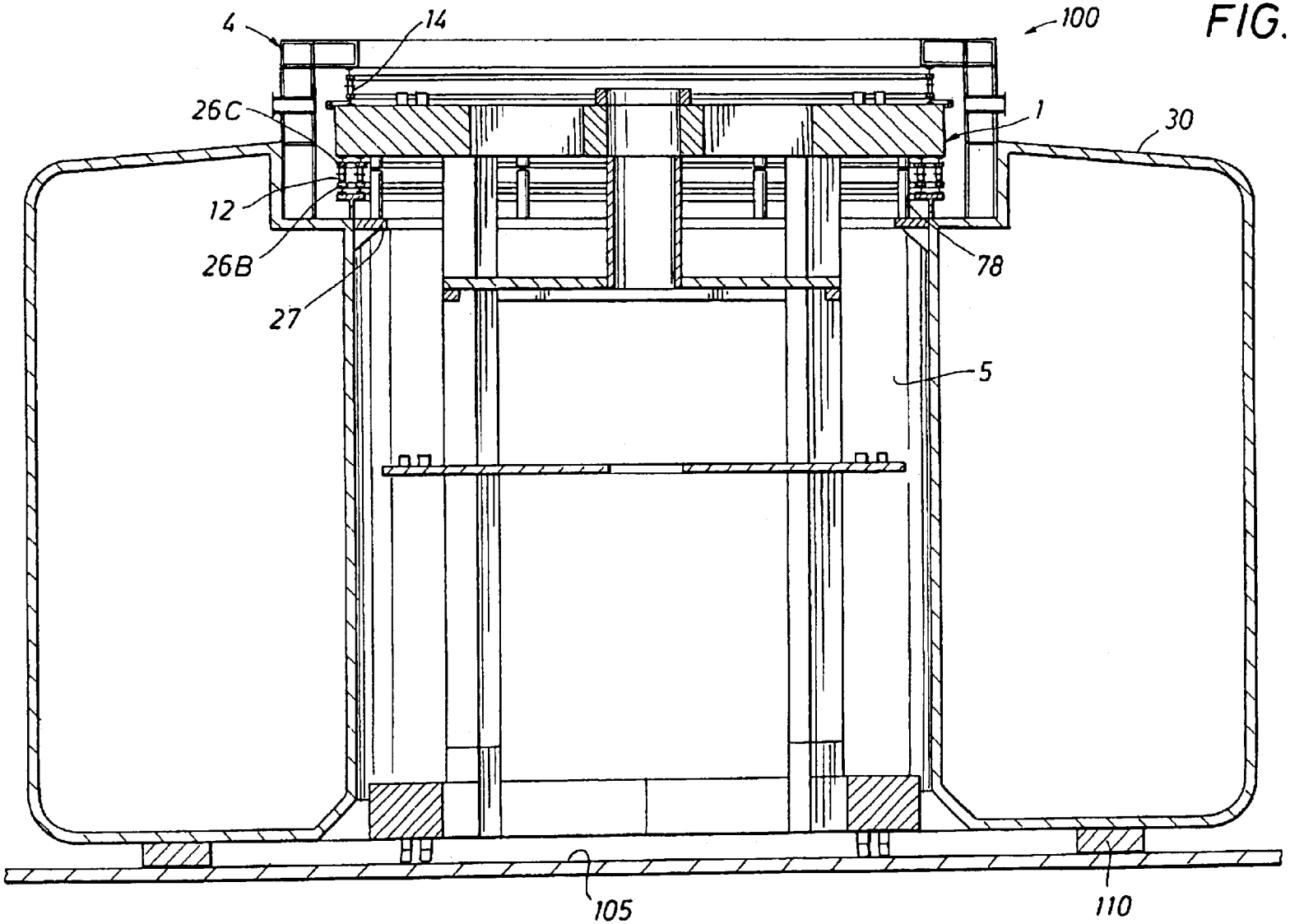
FIG. 16 illustrates the removal of the turret support blocks from the drydock floor, installation of the vertical bearing wheel assembly, and assembly of a bearing support structure about the main deck.
Figure 17:
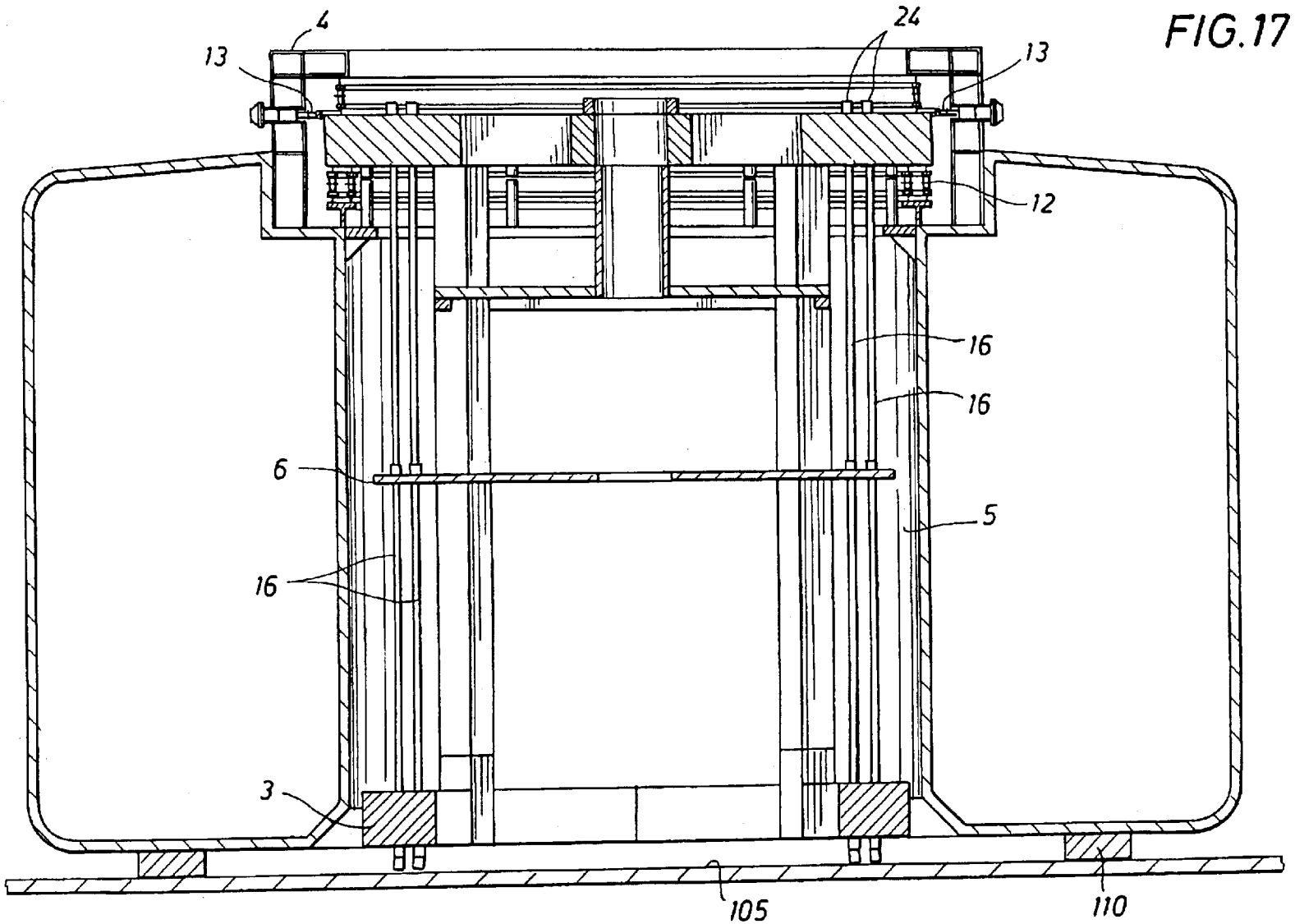
FIG. 17 illustrates installation of the radial load bearing assemblies and installation of "I" tubes for the risers.

FIGS. 16 and 17 illustrate installation of vertical rollers 12 between main deck 1 rails 26B and assembly of bearing support structure 4 between the vessel moonpool and the outer ring of main deck 1 and installation of radial load rollers 13. FIG. 4A shows more detail concerning the placement of bearing support structure 4 and the rollers of the vertical and radial bearing assemblies. After the bearing support structure 4 is installed, uplift rollers 14 and radial rollers 13 are installed. The jacks 78 are now removed, and the entire turret 100 is rotatably supported on the moonpool 5 by vertical and bearings 12. I tubes 16 are installed via riser hangoffs 24 and corresponding openings in deck 6 and chain deck 3. FIG. 17 shows the riser I tubes 16 installation complete. At this stage, the vessel can be floated out of drydock into the water 500 as shown in FIG. 18 and the remainder of the turret constructed at dockside with lifting cranes suited for the purpose.

Figure 18:
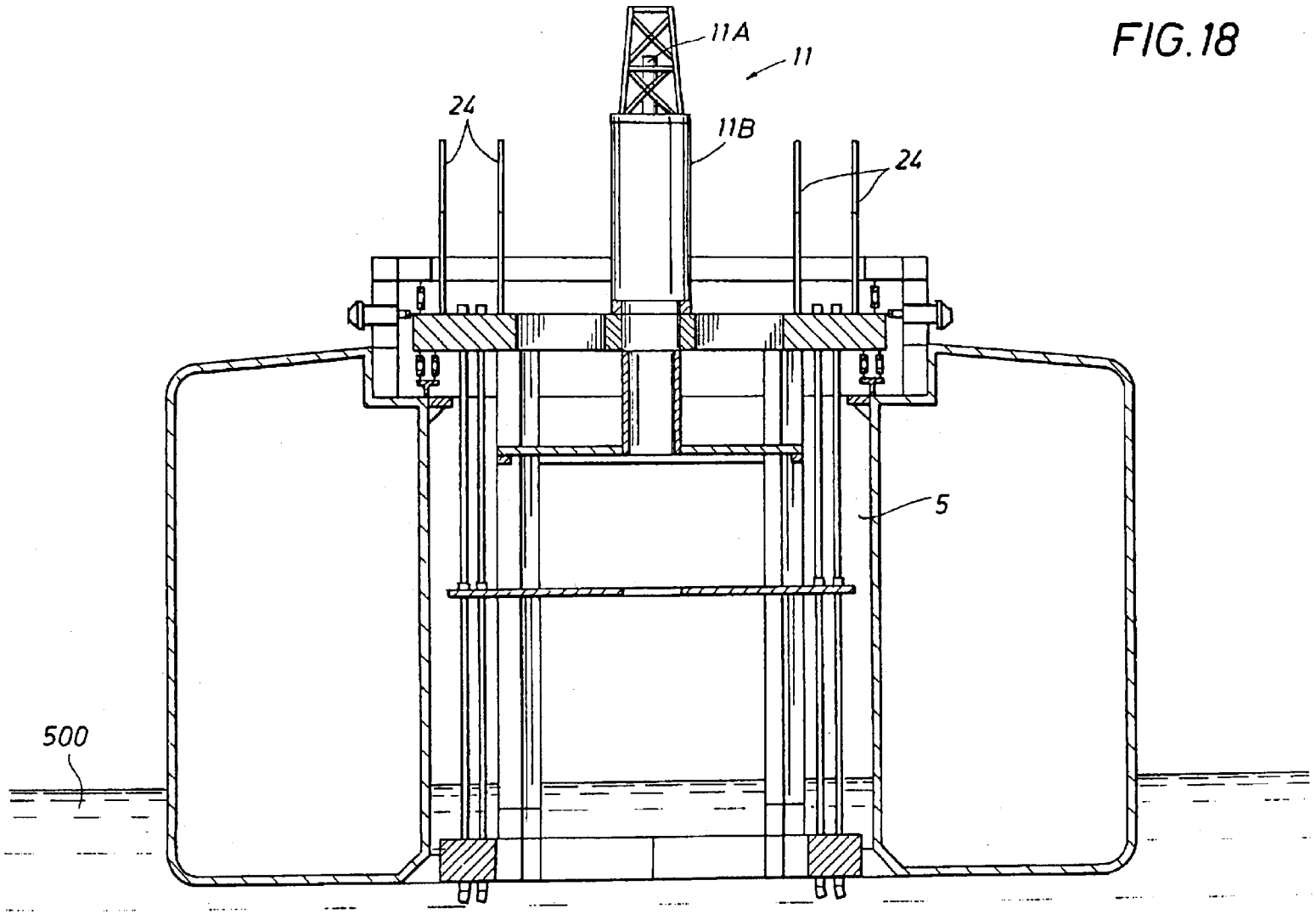
FIG. 18 illustrates, after the vessel has been floated from drydock to dockside, the installation of the swivel stack assembly, the torque tube assembly and pull-in deck support columns mounted on top of the main deck.
Figure 19:
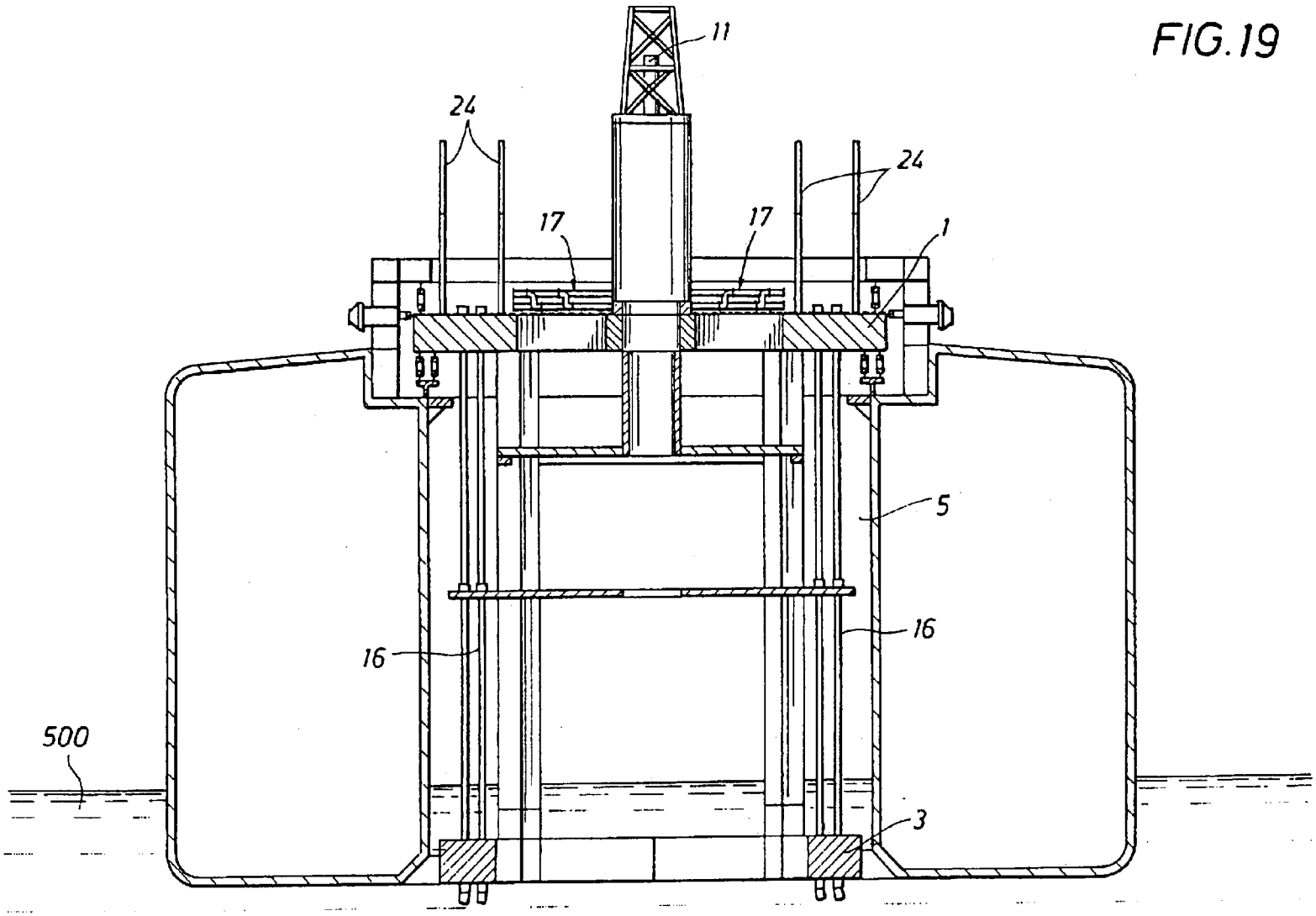
FIG. 19 illustrates installing skid-mounted manifold systems on the main deck.

FIG. 18 shows the installation of the swivel stack 11A and torque tube 11B of the swivel stack and torque tube assembly 11 (See FIG. 1) and pull-in deck support columns 24. FIG. 19 illustrates skid-mounted manifold systems 17 mounted on main deck 1 for connection to risers where the risers are pulled into the riser I tubes 16 after the vessel moves to a mooring location in the sea.

Figure 20:
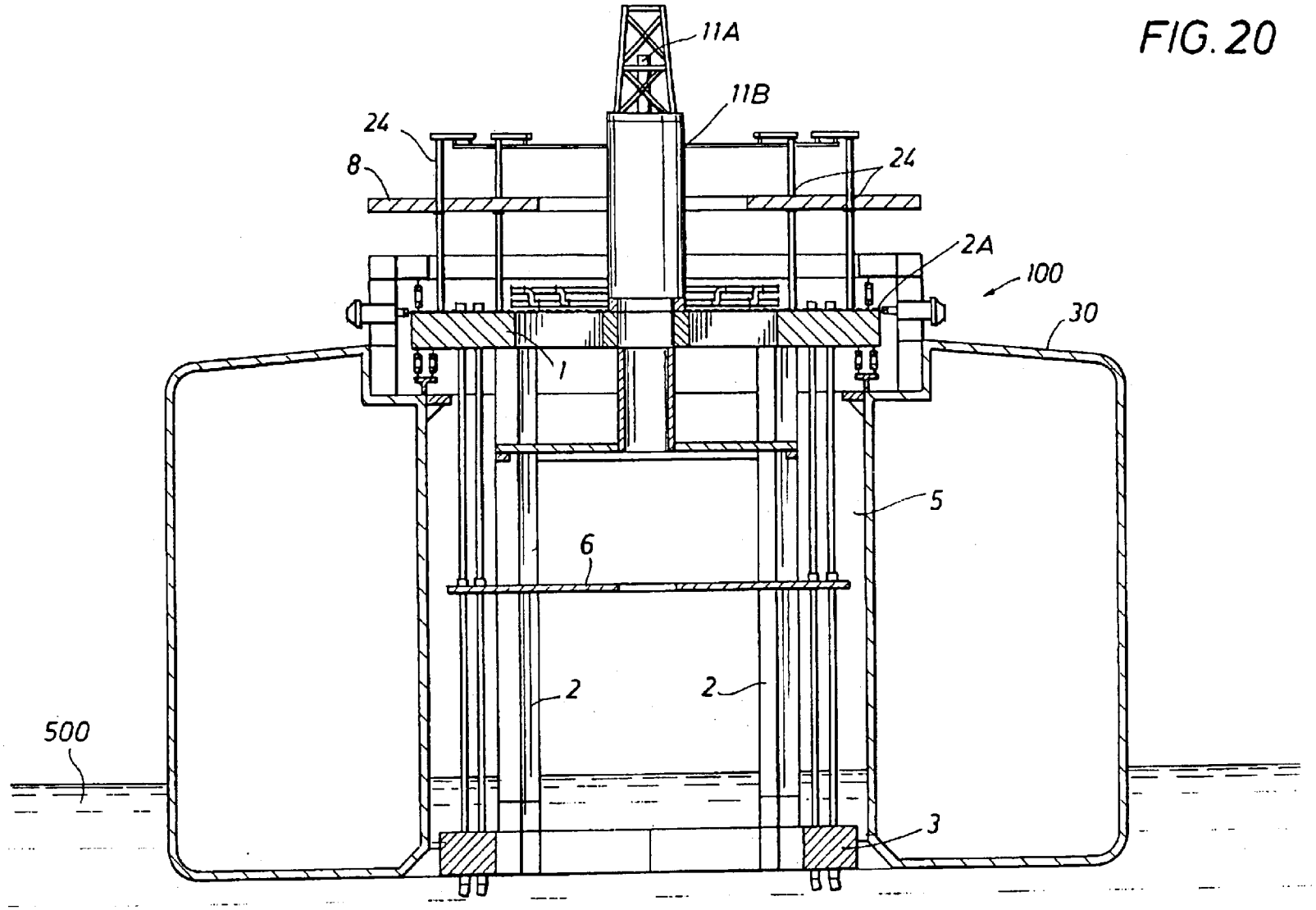
FIG. 20 illustrates installing a pull-in deck between the vessel and the torque tube assembly.

FIG. 20 illustrates the construction of pull-in deck 8 on support columns 2A, and as illustrated in FIG. 1A torque arm 6 is later installed between the vessel 30 and the torque tube 11B.

The installation of the turret 100 is now complete while at dockside in the water. The vessel can be readied for sailing to an operative location in the sea where the turret serves to moor the vessel and to transfer hydrocarbon products to the vessel while the vessel is free to weathervane with respect to the turret.

Alternative Construction Procedure—Partial Turret Construction with the Vessel at Drydock An alternative construction procedure for installing a very large turret in a vessel provides for partial construction of the turret (the lower part) with the vessel at drydock and fabricating the main deck at a separate fabrication yard. The vessel is floated out of drydock into the water, and while at dockside, the main deck is lifted with a large capacity crane and assembled to the lower part of the turret.

Figure 21:
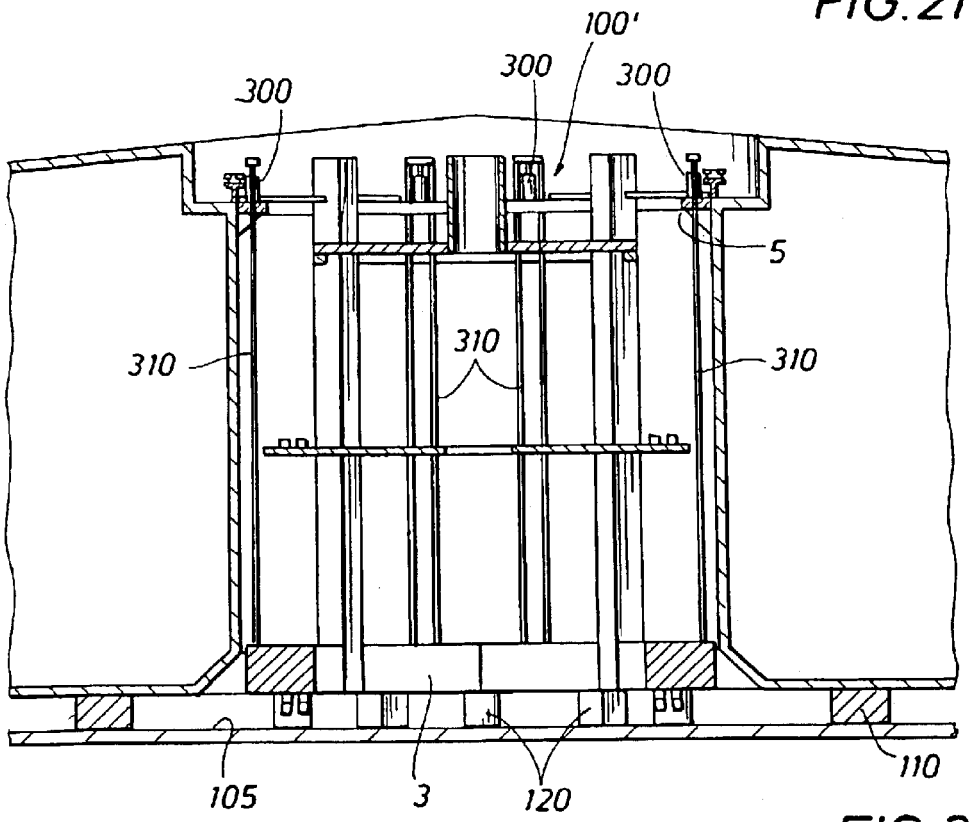
FIGS. 21–24 depict steps of an alternative construction method incorporating use of a higher lift capacity crane. In this alternative, the vessel support blocks are taller than the turret support blocks. After the chain table, support columns and intermediate deck have been assembled in drydock, lift jacks and lifting rods are used to support the partially completed turret from the moonpool shelf, after which the vessel is floated out of drydock into the water and a pre-constructed main deck is lifted at dockside onto the columns of the partially completed turret.
Figure 22:
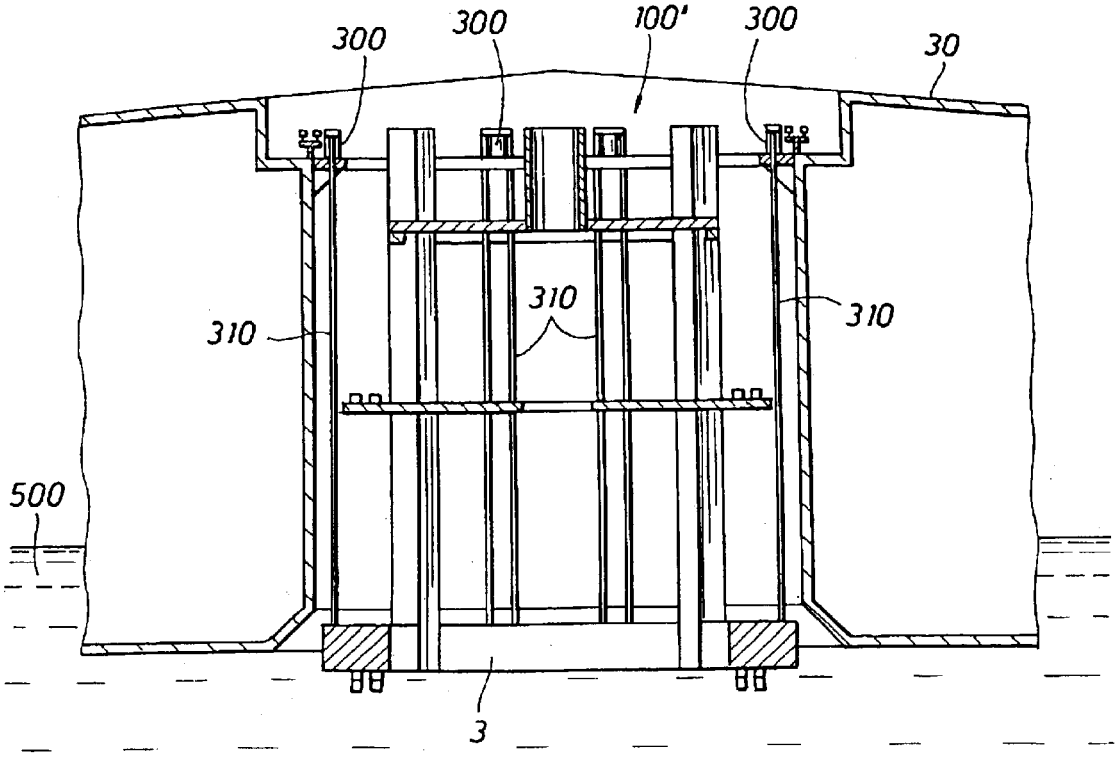

FIGS. 1–8 as described above are generally identical for this alternative procedure except that the blocks 120 beneath the chain table 3 are lower in height than the vessel support blocks 110. For this alternative construction procedure, different construction steps follow thereafter and are described first by reference to FIG. 21. Lift jacks 300 are installed in moonpool 5 with lifting rods 310 connected to chain table 3 so that, as shown in FIG. 22, the lower portion 100' of the turret 100 can be supported by the lift jacks 300 and lifting rods 310, and the support blocks 120 removed. The vessel 30 can be floated from drydock and into the water 500 where crane lifting capacity is large enough to lift the main deck in one piece (as described below). It is generally advantageous to move the vessel 30 out of drydock as quickly as possible to minimize drydock charges for vessel fabrication and modification.

Figure 23:
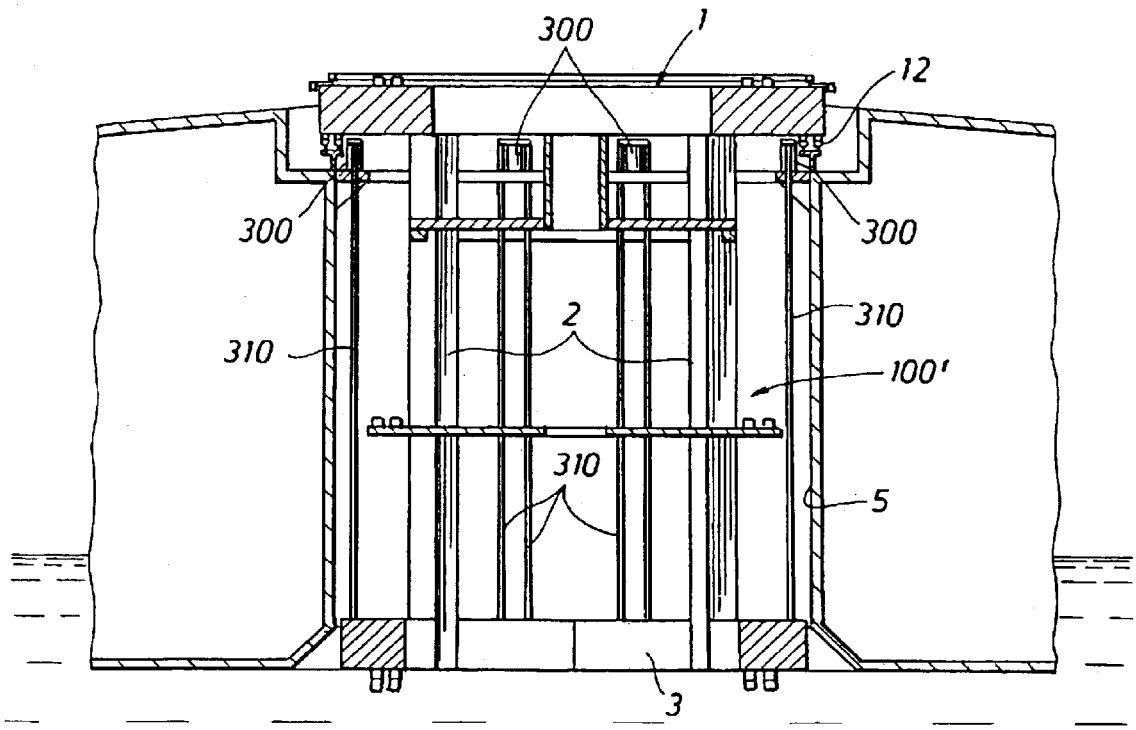

As shown in FIG. 23, the main deck 1 has been assembled in a fabrication yard, and there the two vertical facing surfaces 26U, 26B' and the radial surface 26R have been machined on it. (Alternatively, the support surfaces for such rails have been machined and the rails installed on such surfaces.) Such surfaces are described by reference to FIG. 4A and in the above-mentioned U.S. patent application Ser. No. 10/325,122 incorporated by reference herein. The same or similar surface machining tool 200 (See FIGS. 4 and 14) is used to machine the moonpool rails and the deck bearing rails. (Alternatively, the tool 200 is used to machine the T-flange surfaces 27.) As shown in FIGS. 23 and 4A, the vertical load rollers 12 are installed beneath the vertical facing machined surfaces and rails 26U on the main deck 1 and the machined surfaces and rails 26B of the flange 27 of moonpool 5. The main deck 1 is now rotatably supported by vertical load rollers on the rails 26B of the moonpool 5. The lower turret 100' continues to be supported independently of main deck, because it is supported by jacks 300 and lift rods 310 to chain table 3. Sufficient vertical height exists for the installation of main deck 1 on the moonpool 5, because turret support blocks 120 are lower in height than vessel support blocks 120, thereby placing the lower turret 100' lower in the moonpool during initial construction.

Figure 24:
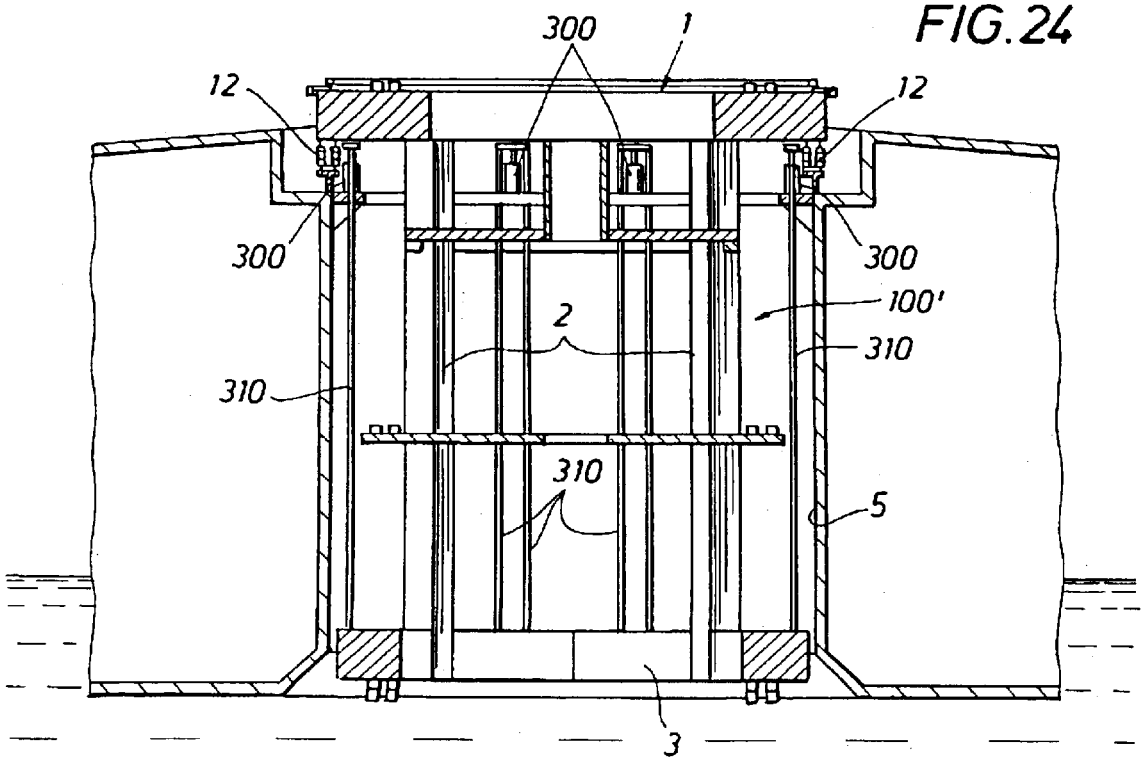

As shown in FIG. 24, the lower turret 100' is lifted up by the lift jacks 300 and lift rods 310 until the columns 2 are in contact with bottom surfaces of the spokes of main deck where they are welded thereto. The entire turret is now supported vertically by the load rollers 12 on upward facing rails 26B of the moonpool 5. The lifting jacks and lifting rods are then removed.

The final assembly steps for this alternative method are identical to those described above by reference to FIGS. 16–20, but they are done with the vessel out of drydock and in the water at dockside.

What is claimed is:

1. A method of fabricating a turret having an upper part and a lower part in a moonpool of a vessel comprising the steps of:

positioning a vessel at dry dock, providing a moonpool in said vessel, constructing at least a lower portion of said turret while at drydock inside said moonpool, and constructing said upper portion of said turret in a fabrication facility, and floating said vessel out of drydock to dockside where said upper portion of said turret is connected to said lower part, and rotatably supporting said turret to said moonpool.

2. A method of fabricating a turret having an upper part and a lower part in a moonpool of a vessel comprising the steps of:

positioning a vessel at dry dock, providing a moonpool in said vessel, constructing at least a lower portion of said turret while at drydock inside said moonpool, and constructing an upper portion of said turret and, connecting said upper part to said lower part of said turret, and constructing said upper portion of said turret in a fabrication facility, and floating said vessel out of drydock to dockside where said upper portion of said turret is connected to said lower part, and rotatably supporting said turret to said moonpool, wherein said upper portion of said turret is constructed in said moonpool and connected to said lower part, and thereafter floating said vessel out of drydock.

3. The method of claim 2 wherein, said lower portion of said turret includes a chain table and at least one column extending vertically from said chain table to a top end of said at least one column, and said moonpool includes a machined upward facing bearing surface, and turret support blocks support said chain table on said drydock, said upper portion of said turret includes a main deck with a bottom facing bearing surface, and said method further comprises the steps of, constructing said main deck while said lower portion of said turret is supported by said support blocks on said drydock by connecting said main deck to said top end of said at least one column, machining said main deck bottom facing bearing surface while said main deck is supported to said at least one column, to create a machined bottom facing bearikng surface, installing jacks between said moonpool and said main deck, jacking up said main deck with said at least one column and chain table vertically, removing said support blocks, installing a bearing structure between said moonpool upward facing bearing surface and said main deck bottom facing bearing surface, and jacking down said main deck so that said turret is supported from said moonpool by said bearings.

4. The method of claim 3 wherein, said turret support blocks are higher than vessel support blocks in said drydock so that while said main deck, and at least one column and chain table are supported on said turret support blocks, a predetermined vertical height exists between said main deck bottom facing bearing surface and said upward facing bearing surface of said moonpool for a machining tool to be placed beneath said bottom facing bearing surface for machining same.

5. The method of claim 3 wherein, said bearing structure includes top and bottom rails and a roller, each rail having upper and lower surfaces, and further including the steps of, installing said bearing structure such that said upper surface of said top rail is fastened to said bottom facing bearing surface of said main deck, and said lower surface of said bottom rail is fastened to said machined upward facing bearing surface of said moonpool and said roller is disposed between said lower surface of said top rail and said upper surface of said bottom rail.

6. A method of fabricating a turret having an upper part and a lower part in a moonpool of a vessel comprising the steps of:

positioning a vessel at dry dock, providing a moonoool in said vessel, constructing at least a lower portion of said turret while at drydock inside said moonpool, and constructing an upper portion of said turret and, connecting said upper part to said lower part of said turret, and constructing said upper portion of said turret in a fabrication facility, and floating said vessel out of drydock to dockside where said upper portion of said turret is connected to said lower part, and rotatably supporting said turret to said moonpool, wherein said lower portion of said turret includes a lower chain table and at least one column which extends vertically therefrom, and said method includes the step of providing turret support blocks on said drydock for supporting said chain table.

7. The method of claim 6 further comprising, installing lift jacks and rods between said moonpool and said chain table, lifting said chain table and said at least one column with said lift jacks and rods from said turret blocks, floating said vessel and lower portion of said turret from said drydock to a dockside position, fabricating a main deck with a machined bottom facing bearing surface, provided a machined upward facing bearing surface on said moonpool, installing said main deck with a bearing structure between said machined bottom facing bearing surface of said main deck and said upward facing bearing surface of said moonpool, and lifting said chain table and said at last one column with said lift jacks and rods for connection of said at least one column to said main deck.

8. The method of claim 7 wherein, said turret support blocks are lower than vessel support blocks in said drydock so that while said at least one column and chain table are supported by said lift jacks and rods, sufficient vertical space exists for installation of said main deck and said bearings on said upward facing bearing surface of said moonpool, such that said at least one column and chain table can be lifted vertically for connection to said main deck.

9. The method of claim 7 wherein, said bearing structure includes top and bottom rails and a roller, each rail having upper and lower surfaces, and further including the steps of, installing said bearing structure such that said upper surface of said top rail is fastened to said bottom facing bearing surface of said main deck, and said lower surface of said bottom rail is fastened to said machined upward facing bearing surface of said moonpool and said roller is disposed between said lower surface of said top rail and said upper surface of said bottom rail.

* * * * *